United States Patent [19]

Claasen

[11] 4,092,437

[45] May 30, 1978

[54] METHOD OF CANNING FOODS

[76] Inventor: Antonius Bernardus Claasen, Sperwerlaan 4, Leende, Netherlands

[21] Appl. No.: 731,835

[22] Filed: Oct. 12, 1976

[30] Foreign Application Priority Data

Oct. 13, 1975 Netherlands ..... 7512017

[51] Int. Cl.[2] ..... A23L 1/04; A23L 1/218; A23L 1/221

[52] U.S. Cl. ..... 426/573; 426/397; 426/615; 426/643; 426/650

[58] Field of Search ..... 426/573, 650, 49, 638, 426/52, 321, 324, 397, 331, 332, 615, 643

[56] References Cited

U.S. PATENT DOCUMENTS

| | | | |
|---|---|---|---|
| 2,181,239 | 11/1939 | Kelly et al. | 426/573 |
| 2,322,880 | 6/1943 | Pollak | 426/49 |
| 3,255,019 | 6/1966 | Engelland | 426/49 |

FOREIGN PATENT DOCUMENTS

| | | | |
|---|---|---|---|
| 331,161 | 6/1930 | United Kingdom | 426/49 |

*Primary Examiner*—Jeanette M. Hunter

[57] ABSTRACT

In canning foods, herbs and spices are added dispersed in a gel thereby preventing spice and/or herb particles floating on top of the liquid in which the foods are kept and subsequent interference with proper sealing of the cans. This ensures accurate dosaging. Suitable materials for making the gel are cellulose derivatives.

6 Claims, No Drawings

METHOD OF CANNING FOODS

This invention relates to a method of packing foods such as onions, gherkins, herrings and the like in tin or glass containers, in which a portion of herbs, spices and the like and possibly one or more preservatives are to be added to the liquid in which the foods are kept.

In order to prevent that air is entrapped during the sealing of the containers, which would result in deterioration, it is a common expedient to overfill the containers with the liquid, such as a pickle. This has the disadvantage that part of the herbs and/or spices which float on the liquid will be removed over the rim and deposit thereon. The result is defective sealing, as a consequence of which the contents will deteriorate after a shorter or longer period of time. Another disadvantage is that the amount of herbs and spices will vary from container to container.

It is an object of the present invention to eliminate these disadvantages.

According to the present invention, the herbs and/or spices are added in the form of a dispersion of said herbs and/or spices in a gel. Preferably the gel, with the herbs and/or spices dispersed therein, is made in the form of a ribbon, from which a pre-determined length is cut off for each container, and deposited in the container preferably before the food and/or the liquid, such as a pickle, are introduced therein. Preferably one or more preservatives are used, and introduced in the container along with the gel.

Naturally, use is made of a gel which is gradually dissolved only after the containers have been filled and sealed. It is self-evident that the gel should be fully soluble, impart no taste, flavour or smell, and be suitable for consumption.

This invention further relates to foods packed by the method according to the invention.

The gel preferably consists of a cellulose derivative, which is perfectly indifferent, both as regards taste and toxicity. Preferably a gel is used consisting of a cellulose ether and most preferably carboxymethyl cellulose. The gel is mixed with the herbs and/or spices in a vessel equipped with a stirrer so that a homogeneous mass is formed. The mixture is supplied in the form of a ribbon, via a tube equipped with a worm or the like, to a place where it is used, where suitable lengths are cut off from it by a rotating or reciprocating blade or knife.

The present invention also relates to a mixture comprising one or more herbs and/or spices and suitable for use in the method of canning according to the invention, and to a method of producing such a mixture. The present invention also encompasses such a mixture in the form of a ribbon. This invention furthermore relates to apparatus for packing foods, such as gherkins, onions, herring and the like, which comprises an extruder by means of which herbs and/or spices dispersed in a gel can be brought into the form of a ribbon, from which pre-determined lengths can be cut off, for example, with a rotary knife, and deposited in a container.

EXAMPLE 1 kg benzoic acid and 1 kg sodium benzoate are dissolved with heating and stirring in 918 liters water. In this mixture, 80 kg sodium carboxymethyl cellulose of medium viscosity are dissolved with rapid stirring, whereafter the mixture is cooled in the air to 30° C.

2 Parts by weight of the desired mixture of herbs and spices, comprising, for example, peppers, fennel seed, finely-cut laurel, whole cloves, coriander seed, chopped onion, are added to 3 parts by weight of the gel thus prepared, and stirred into a homogeneous mass.

The mixing period and mixing rate required for producing the desired homogeneity will vary for each mixture of herbs and spices, and can readily determined by those skilled in this art for each individual case.

Subsequently the mass is supplied to an extruder and extruded in the form of a ribbon, from which pre-determined lengths are cut off, for example, by means of a rotary knife, which fall into the respective containers.

The dosage is excellently reproducible, and problems experienced in conventional canning methods, such as defective sealing of containers, do not occur.

The ratio between the amounts of gel and herbs and spices depends on the particular herbs and spices used and can be readily determined by one of ordinary skill in the art. The same applies to the composition of the liquid in which the food is kept. For example, in the case of gherkins and onions, a suitable liquid is a 3 to 4% by weight solution of acetic acid in water.

I claim:

1. In a method of packing foods wherein an edible liquid is added to overflowing to a solid food product containing at least one herb and/or spice within a container and the container is sealed, the improvement which comprises adding the herb and/or spice dispersed in an edible gel to the food product, said gel being soluble in the liquid component of the food product.

2. The method of claim 1 wherein the gel in the form of a ribbon is divided into predetermined lengths, with a lengthunit of gel being deposited in the container.

3. The method of claim 1 wherein the solid food product and the edible liquid are introduced in the container after the gel and at least one preservative have been introduced into the container.

4. The method of claim 1 wherein the gel containing the herb and/or spice is extruded in the form of a ribbon.

5. The method of claim 1 wherein the gel is a sodium carboxymethyl cellulose.

6. A packed food produced by the method of claim 1.

* * * * *